US005393049A

United States Patent [19]

Nelson

[11] Patent Number: 5,393,049

[45] Date of Patent: Feb. 28, 1995

[54] INDOORS MINIATURE BASKETBALL PRACTICE APPARATUS

[76] Inventor: George Nelson, 17 Vega St., New Britain, Conn. 06051

[21] Appl. No.: 183,200

[22] Filed: Jan. 18, 1994

[51] Int. Cl.[6] ..... A63B 69/00

[52] U.S. Cl. ..... 273/1.5 A; 273/396; 273/397; 273/401; 273/402

[58] Field of Search ..... 273/1.5 R, 1.5 A, 394, 273/395, 396, 397, 401, 402

[56] References Cited

U.S. PATENT DOCUMENTS

| | | | |
|---|---|---|---|
| 3,233,896 | 2/1966 | King | 273/1.5 A |
| 3,776,550 | 12/1973 | McNabb | 273/1.5 A |
| 3,901,506 | 8/1975 | Caveney | 273/1.5 A |
| 4,291,885 | 9/1981 | Cohen | 273/1.5 A |
| 4,579,340 | 4/1986 | Jenkins et al. | 273/1.5 A |
| 5,016,875 | 5/1991 | Joseph | 273/1.5 A |
| 5,171,009 | 12/1992 | Filewich et al. | 273/1.5 A |
| 5,183,253 | 2/1993 | Grimaldi et al. | 273/1.5 A |

*Primary Examiner*—William H. Grieb
*Attorney, Agent, or Firm*—Handal & Morofsky

[57] ABSTRACT

A basketball practice system comprising a backboard made of a rigid or semi-rigid material and having a generally a planar configuration is disclosed. A frame structure is secured to the backboard and helps to support a guiding net configured and dimensioned to guide a basketball into a narrow port defined by the guiding net. Cross braces are secured between the frame structure and the backboard in order to give rigidity to the frame. Side deflection structure deflects balls which are moving to the left or right, away from the system and guiding them into the guiding net. This deflecting structure may comprise nets. A basketball net is positioned above the narrow port and a bendable tubular guiding member, which comprises a bendable tubular member has a spiral backbone and a skin secured to the spiral backbone, is coupled to the narrow port and configured to receive a ball and guide it toward a player using the inventive basketball practice system is disclosed.

20 Claims, 8 Drawing Sheets

INDOORS MINIATURE BASKETBALL PRACTICE APPARATUS

TECHNICAL FIELD

The present invention relates to systems for providing practice for basketball tossing from a wide variety of possible positions and locations with automated return of the ball to the player.

BACKGROUND

One of the most popular participation sports in America today is basketball. Perhaps there is not a boy in America who has not grown-up without "shooting" baskets or playing in a more formalized team game setting. No wonder then that basketball has spawned such a plethora of related indoor and outdoor games. These range from miniature table top basketball shooting devices to electronic basketball video games and on through to such informal arrangements as shooting crumpled paper balls into waste baskets at the office. The present invention is concerned with devices which are more of the scale of this last type of system, more particularly, indoor devices of somewhat reduced scale but where the overall playing "field" is in the range of five to fifteen feet, or larger. More particularly, the present invention is concerned with systems of this type which also incorporate means for return of a basketball to the player.

As might be expected, there is no shortage of devices for returning balls to basketball players, in order to remove the need for a person, who is practicing alone, to go after and retrieve the ball after each shot. See for example U.S. Pat. No. 4,579,340 to Jenkins et al. in which a tubular net is placed underneath the basketball hoop and basket in order to capture the ball after it goes through the hoop and return it to an automatic shooting device incorporating a solenoid operated plunger. Presumably, this device would also accommodate practice by a number of players with the shooting mechanism being aimed periodically in different directions in response to appropriate control inputs.

However, systems such as those disclosed by Jenkins et al. suffer from numerous disadvantages and disabilities. First of all, the systems are electrically powered and must thus be positioned near a source of power or be dependant on battery power. In addition, the systems are large and cumbersome and incorporate power operated parts resulting in making them expensive and difficult to move around. In addition to these costs, it is almost impossible to put such devices into the mass market without substantial modifications in view of their bulk, cost, and the like. Finally, the Jenkins device suffers from the problem of not being able to return balls which miss the basket, thus rendering it of interest primarily only to professionals.

Many of these problems are addressed in other patents, such as U.S. Pat. No. 3,776,550 of MacNabb. In MacNabb, a very large net is provided underneath a full size basketball hoop and net. Support for a large collection net positioned underneath the basketball hoop and net is provided by a specialized custom made structure of variously shaped and multi-armed support tubes of relatively great cost.

In addition to the net in MacNabb for collecting basketballs which may have missed the basketball hoop, the system also includes a non-flexible chute for receiving the ball at the bottom of the collection net and returning it to the player in a fixed position.

Like many other relatively large sized systems, the MacNabb system is relative expensive to manufacture, cumbersome to put in place, and has a fixed structure which reduces the flexibility of the environment within which the system may be used. While in many circumstances (such as a basketball court) this may not be an important factor, in the context of home use, flexibility to configure the system in a wide variety of configurations is as important a factor as the cost of the system together with such other important factors as the ease with which it may be shipped, moved, stored and so forth. Systems such as MacNabb fail to substantially address any of these problems in a fashion which would render them advantageous for use in the home.

To a certain extent U.S. Pat. No. 5,183,253 to Grimaldi et al. addresses some of these problems. It incorporates a large oversized net for capturing missed basketballs. The net is formed with straight members and supported on a number of feet. For this reason, it is possible that this system can be made relatively compact, although his long tubular ball return members are not susceptible of being substantially reduced in size. In Grimaldi, the collection net which is disposed beneath the basketball hoop is of relatively large size, in order to accommodate the possibility of the basketball missing the backboard, or hitting the backboard or the hoop in an unusual angle, resulting in a relatively large deviation in its path from the region proximately surrounding the basketball hoop. However, Grimaldi et al. like MacNabb, is a relatively fixed system taking up a large area and therefore requiring a large area in the home, if it is to be used, even in a somewhat reduced scale version. In addition, because Grimaldi uses simple dowels as his support members, the system suffers from rigidity problems insofar as forces tend to be concentrated at the joinder of the various dowel members or dowels. Finally, Grimaldi et al. suffers from the problem of having a fixed configuration and not one which may be readily adapted to fit a wide variety of environments with different obstacles creating various space requirements.

SUMMARY OF THE INVENTION

In accordance with the present invention, the obvious failings of these prior art systems is addressed in economical and effective fashion to produce a miniaturized basketball practice device whose dimensions are on the same order of magnitude as the room in which it is placed. At the same time, this is achieved while providing for the flexibility of accommodating a wide range of room furniture arrangements and environments, without the necessity of rearranging furniture in order to accommodate the system. At the same time, the system may be compressed into an extremely small size and easily transported either for merchandizing or for storage in the home. At the same time, the cost of the system is extremely low, using largely existing standard structural elements, albeit that they are taken from different areas of technology. Finally, the system achieves all of the above while at the same time providing a high degree of structural rigidity.

More particularly, in accordance with the present invention, a basketball practice system comprising a backboard made of a rigid or semi-rigid material and having a generally a planar configuration is provided. A frame structure is secured to the backboard and helps to support a guiding net configured and dimensioned to guide a basketball into a narrow port defined by the guiding net. Side deflection structure deflects balls which are moving to the left or right, away from the system and guiding them into the guiding net. This deflecting structure may comprise nets. A basketball net is positioned above the narrow port and a bendable tubular guiding member is coupled to the narrow port and configured to receive a ball and guide it toward a player using the inventive basketball practice system.

In accordance with a preferred embodiment the system further comprises a plurality of cross braces secured between the frame structure and the backboard in order to give rigidity to the frame. The tubular guiding member is secured to the backboard at a position on the tubular guiding member proximate to the narrow port. The tubular guiding member comprises a cylindrical member secured to the end of the tubular guiding member and proximate to the narrow port, the tubular member is being secured to the backboard. The bendable tubular member has a spiral backbone and a skin secured to the spiral backbone.

BRIEF DESCRIPTION OF THE DRAWINGS

One way of carrying out the invention is described in detail below with reference to drawings which illustrate only one specific embodiment of the invention and in which.

BEST MODE FOR CARRYING OUT THE INVENTION

Figure 1:
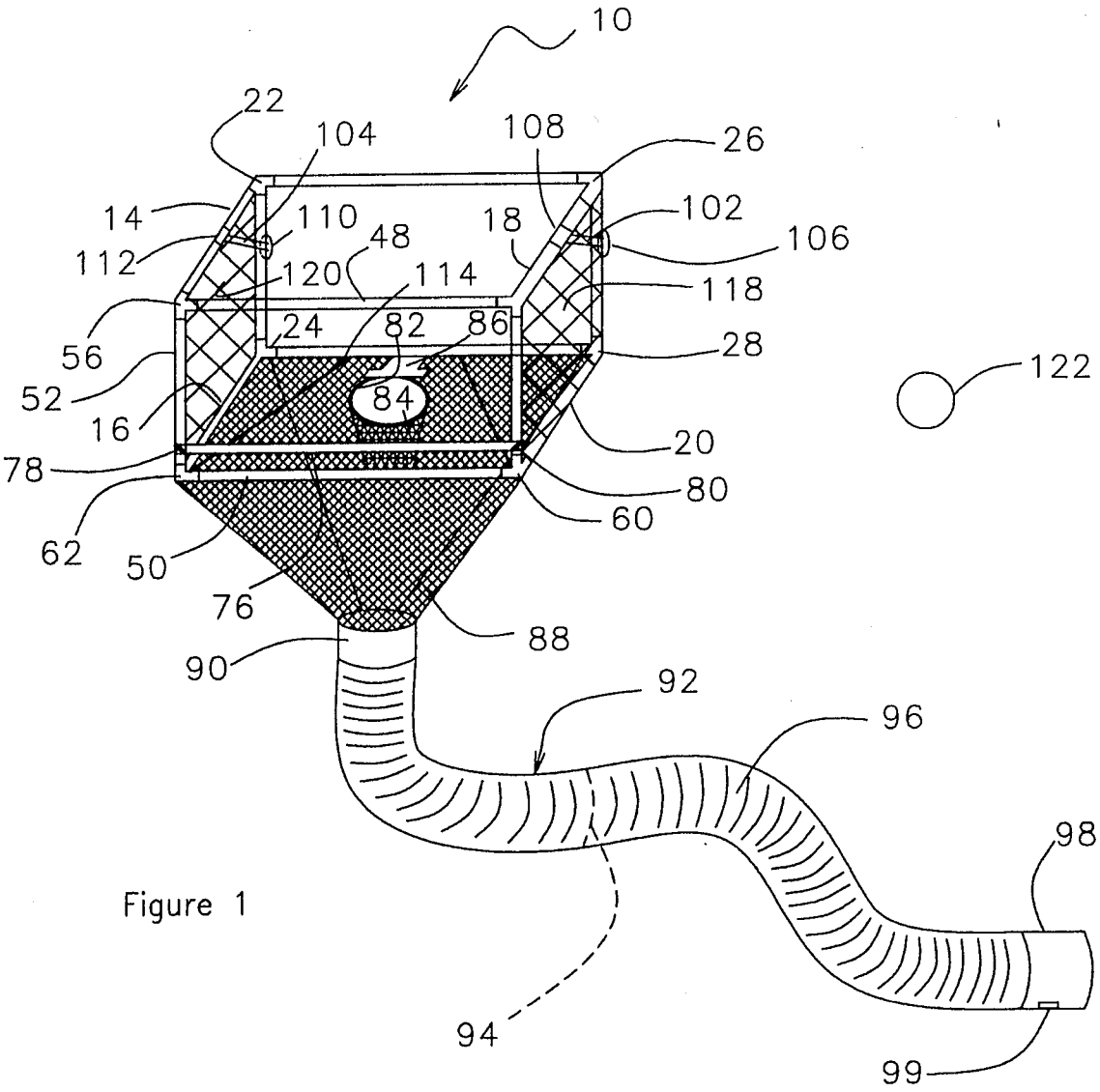
FIG. 1 is a view of a indoor basketball shooting system constructed in accordance with the present invention.

Referring to FIG. 1, a basketball practice system 10 constructed in accordance with the present invention is illustrated. System 10 comprises a rigid plywood backboard 12 of generally rectangular shape which may be mounted on a wall using any suitable means. Backboard 12 may also be made of Masonite, particle board or any other suitable substantially rigid material, having a thickness in the range between $\frac{1}{8}$ and $\frac{1}{2}$ of one inch, typically. Of course, other materials may be used in varying thicknesses as long as they provide a measure of rigidity to system 10.

Figure 3:
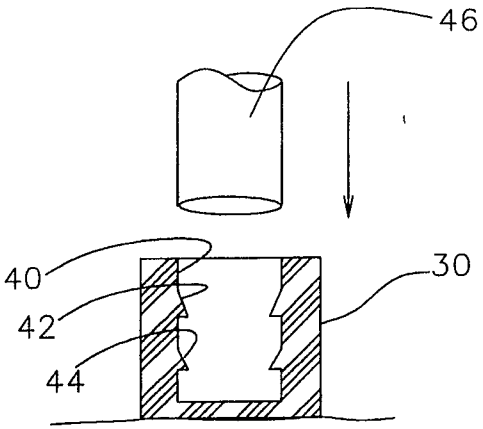
FIG. 3 is a cross-sectional detail of the bracket illustrated in FIG. 2.
Figure 2:
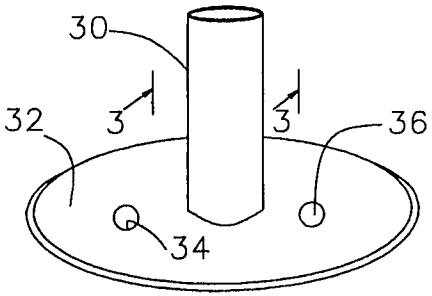
FIG. 2 is a view of a bracket useful in the structure illustrated in FIG. 1.

Horizontal dowels 14, 16, 18, and 20 are mounted on backboard 12 using a plurality of respective brackets 22, 24, 26, and 28, as illustrated in FIG. 1. Brackets 22–28 are of the type which include a base for attaching to backboard 12 and a tubular receiving neck for receiving a dowel. Such a bracket is illustrated in FIG. 2. A tubular receiving neck 30 is integral with a base 32 which includes a pair of screw receiving holes 34 and 36 for receiving screws and screwing the bracket 38 to backboard 12. The neck 30 of the brackets includes a dowel receiving passage 40 which has a pair of annular ribs 42 and 44, on the inside, for engaging a dowel, such as dowel 46, as illustrated in FIG. 3. The brackets may be made of plastic, artificial rubber, or any suitable material with the size of the ribs being increased for more flexible materials in order to insure a tighter grip of the dowel when it is inserted in the neck of its respective bracket.

Figure 4:
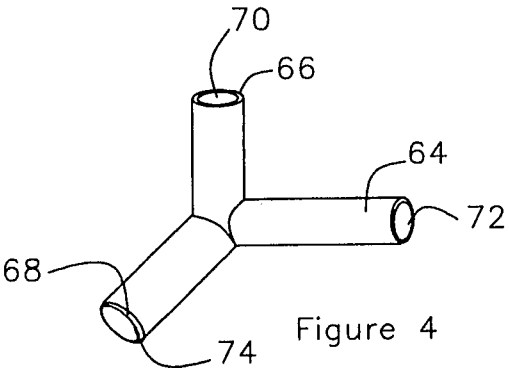
FIG. 4 is an illustration of a corner support type bracket useful in the embodiment of FIG. 1.

As can be seen most clearly in FIG. 1, a rectangular box shape is further defined by a pair of long horizontal dowels 48 and 50 and a pair of short vertical dowels 52 and 54. The dowel structures are maintained in position by plurality of corner brackets 56, 58, 60, and 62 which take the configuration illustrated in FIG. 4. These corner brackets, each have a plurality of necks 64, 66, and 68 which define passages 70, 72, and 74, respectively. The passages 70–74 have ribs substantially identical to ribs 42 and 44, illustrated in FIG. 3.

Referring back to FIG. 1, rebound ball retaining dowel 76 is maintained in position by a pair of rubber bands 78 and 80 which secure dowel 76 to short vertical dowels 52 and 54, respectively. A hoop 82 with an associated basket net 84 are maintained in place by a support 86 which is secured to backboard 12.

Balls shot by the player, are collected by a funnel shaped net 88 which has an output coupled to a tubular coupling member 90, which may be a simple cylinder of metal or section of metal tubing. Coupling 90 is in turn coupled to a length of compressible bendable air conditioner or heating conduit 92, which is of the construction which incorporates a spiral metal rib 94 which acts as a support for an outer casing 96 made of fibrous material, reinforced foil or similar material.

Figure 5:
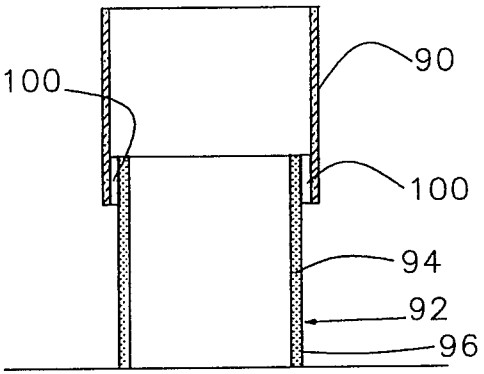
FIG. 5 illustrates the construction of the tubular guiding member used in FIG. 1.

Casing 96, is, in turn, attached to an end coupler 98. Couplings 90 and 98 are attached to conduit 92 by a quantity of silicon caulking compound 100 or other similar material as is illustrated in FIG. 5. In accordance with the preferred embodiment, it is expected that couplings 90 and 98 will be made of plastic or, if desired, metal. Coupling 98 is provided with a mounting member 99 which allows it to be attached to a piece of furniture using a VELCRO brand type fastener or any other suitable fastener. Finally, rigidity to the system is provided by a plurality of diagonal braces 102 and 104, which are made of dowels which are maintained in place by brackets 106, 108, 110, and 112 respectively. Finally, an additional measure of rigidity is provided by a pair of taut rope lines 114 and 116. Balls bouncing towards the side are guided into funnel shape net 88 by a pair of side nets 118 and 120.

During use, balls are tossed from a remote position into the cube defined by the dowel members, perhaps causing them to bounce against backboard 12 and fall through hoop 82, or fall around hoop 82 into funnel shaped net 88. Dowel 76 may be adjusted in position to ensure that balls rebounding off backboard 12 do not fall to the front of net 88. The position of the dowel 76 is easily maintained by rubber bands 78 and 80 and may simply be slid to the desired position where it will be held by the taut rubber bands.

After a ball 122 is thrown, it falls into coupling 90 and is conveyed through conduit 92 to a location remote from the net at which coupling 98 is located. Here it may be caught by the player, who then simply shoots another basket without the necessity of retrieving the basketball.

Figure 7:
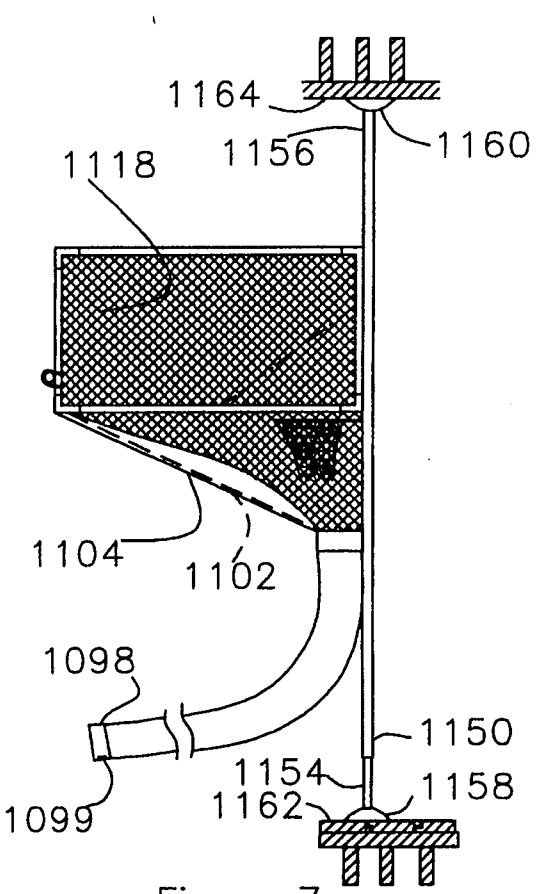
FIG. 7 is a view along lines 7—7 of FIG. 6.
Figure 6:
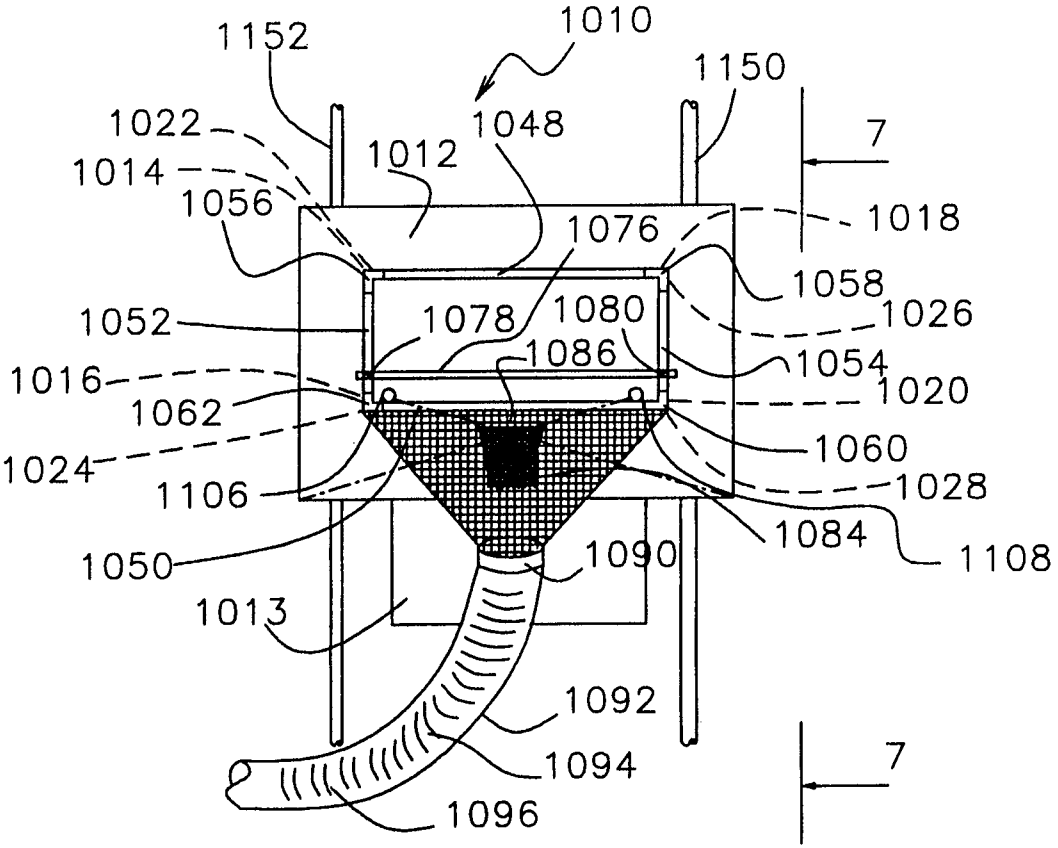
FIG. 6 is an alternative embodiment of the invention.
Figure 8:
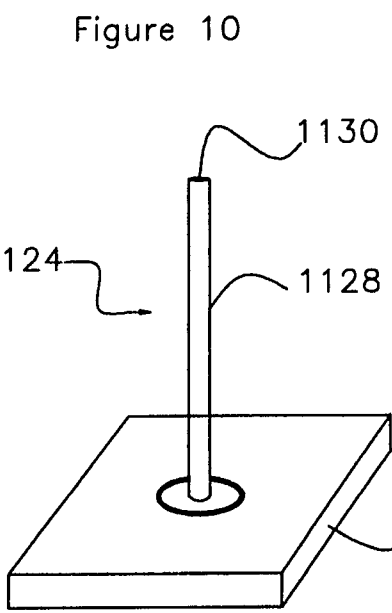
FIG. 8 is a view of a support for supporting the end of the system proximate a player to enable easy ball retrieval.

An alternative embodiment is illustrated in FIGS. 6–8. Generally, similar parts or parts performing analogous, corresponding or identical functions to those of the FIG. 1 embodiment are numbered herein with numbers which differ from those of the earlier embodiment by multiple of one thousand.

Referring in particular to FIG. 6, a basketball practice system 1010 having certain characteristics in common with the system of the earlier embodiment is illustrated. Support for the system is provided by a backboard 1012. Backboard 1012 has an extension 1013 integral with it. In turn, backboard 1012 supports a plurality of dowels. In particular, horizontal dowels 1014, 1016, 1018, and 1020 are mounted on backboard 1012 using a plurality of respective brackets 1022, 1024, 1026, and 1028, as illustrated in FIGS. 6–7. Brackets 1022–28 are of the type which include a base for attaching to backboard 1012 and a tubular receiving neck for receiving a dowel. The bracket illustrated in FIG. 2 may be used. A rectangular box is further defined by a pair of long horizontal dowels 1048 and 1050 and a pair of short vertical dowels 1052 and 1054. The dowel structures are kept together by a plurality of corner brackets 1056, 1058, 1060, and 1062 which take the structure illustrated in FIG. 4.

A rebound ball retaining dowel 1076 is maintained in position by a pair of rubber bands 1078 and 1080 which secure dowel 1076 to short vertical dowels 1052 and 1054 respectively. A hoop 1082 with an associated basket net 1084 is maintained in place by a support 1086 which is secured to backboard 1012.

Shots by the player, are collected by a funnel shaped net 1088 which has an output coupled to a tubular coupling member 1090, which may be a simple cylinder of metal or plastic, or section of metal tubing. Coupling 1090 is secured to backboard 1012 and is, in turn, coupled to a length of compressible bendable air conditioner or heating conduit 1092. Conduit 1092 is of a construction which incorporates a spiral metal rib 1094 which acts as a support for an outer casing 1096 made of paper, foil or similar material. Casing 1096, is, in turn, attached to an end coupler 1098. Couplings 1090 and 1098 are attached to conduit 1092.

In accordance with the preferred embodiment, it is expected that couplings 1090 and 1098 will be made of plastic or, if desired, metal. Coupling 1098 is provided with a mounting member 1099 which allows it to be attached to a piece of furniture using a VELCRO brand fastener or any other suitable fastener. Alternatively, member 1099 may be attached to a stand 1124 comprising a base 1126, vertical support pole 1128 and VELCRO mating member 1130. Finally, rigidity to the system is provided by a plurality of diagonal braces 1102 and 1104, which are made of dowels which are maintained in place by brackets 1106, and 1108. Balls bouncing towards the side are guided into funnel shaped net 1088 by a pair of side nets 1118 and 1120.

Figure 9:
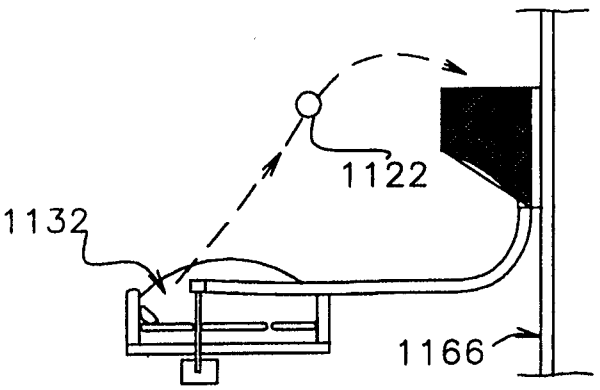
FIG. 9 illustrates the system of the present invention in use.

As illustrated in FIG. 9, during use, balls are tossed by the player 1132 from a remote position into the cube defined by the dowel members, perhaps causing them to bounce against backboard 1012 and fall through hoop 1082 or fall around hoop 1082 into funnel shaped net 1088. Dowel 1076 may be adjusted in position to ensure that balls 1122 rebounding off backboard 1012 do not fall to the front of net 1088. After a ball 1122 is thrown, it falls into coupling 1090 and is conveyed through conduit 1092 to remote location at which coupling 1098 is located where it may be caught by the player, who then simply shoots another basket without the necessity of retrieving the basketball.

As can be seen most clearly in FIG. 7, the system may be mounted between floor and ceiling using a pair of spring mounted vertical supports 1150 and 1152. The supports generally have spring loaded gripping feet 1154 and 1156 which incorporate rubber cups 1158 and 1160 which enable them to be secured, to floor 1162 and ceiling 1164, thus providing for a secure support of the backboard 1012 which is secured to the vertical members 1150 and 1152 by any appropriate structure. Alternatively, the system may be supported by having the backboard nailed or put on a picture hook secured to a wall 1166 as illustrated in FIG. 9.

Figure 19:
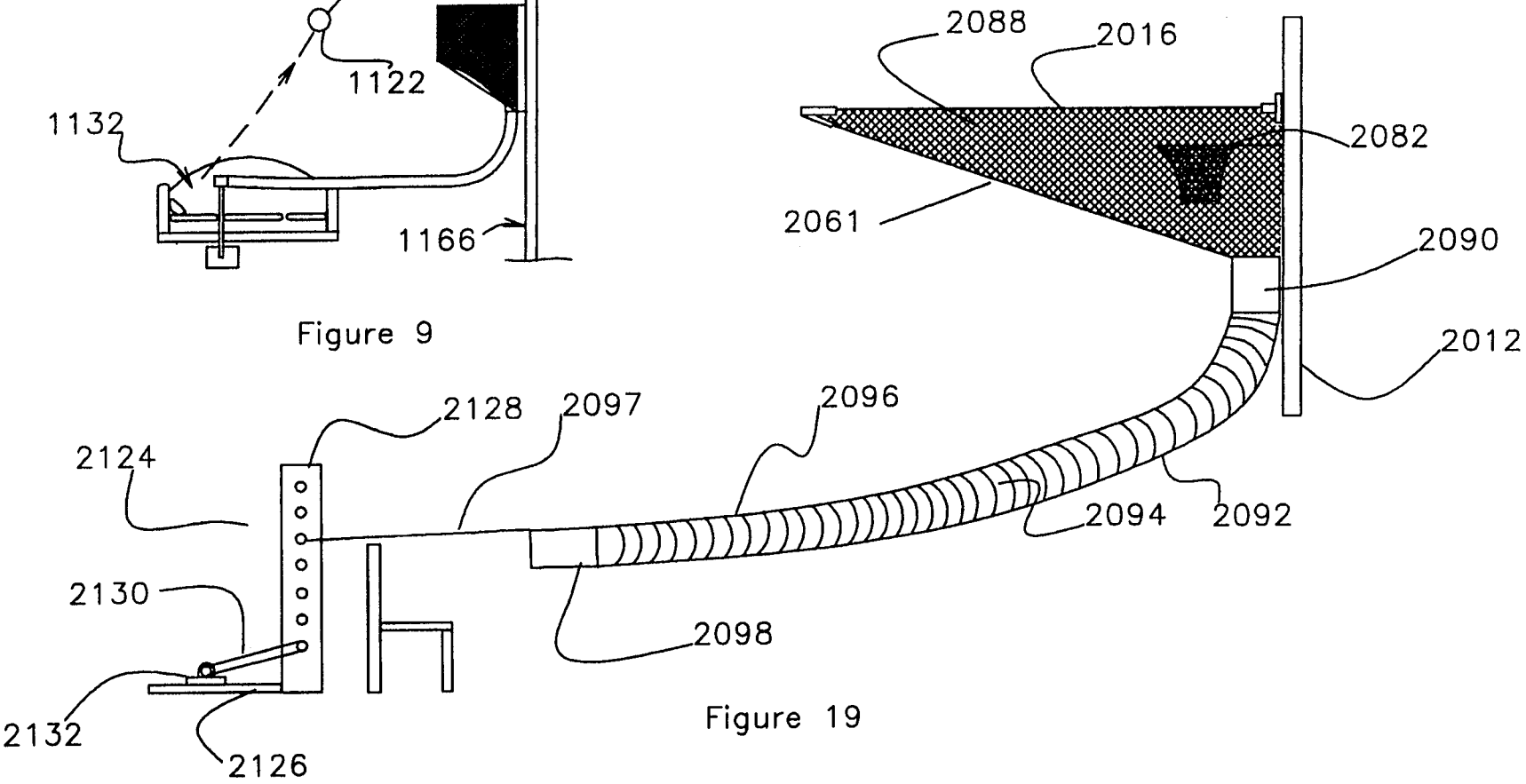
FIG. 19 is a side view of the invention shown in FIG. 18 including, a conduit support stand.
Figure 18:
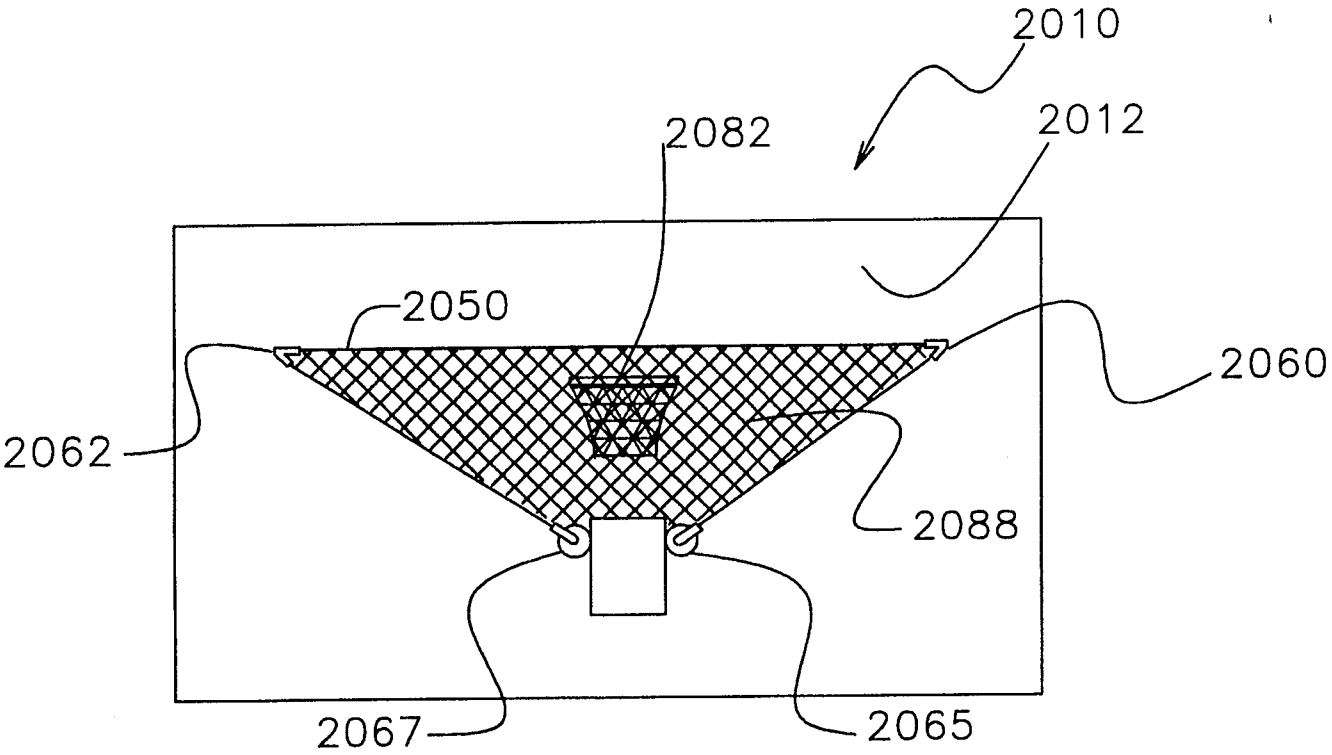
FIG. 18 is a front view of the net portion of a second alternative embodiment of the invention.
Figure 20:
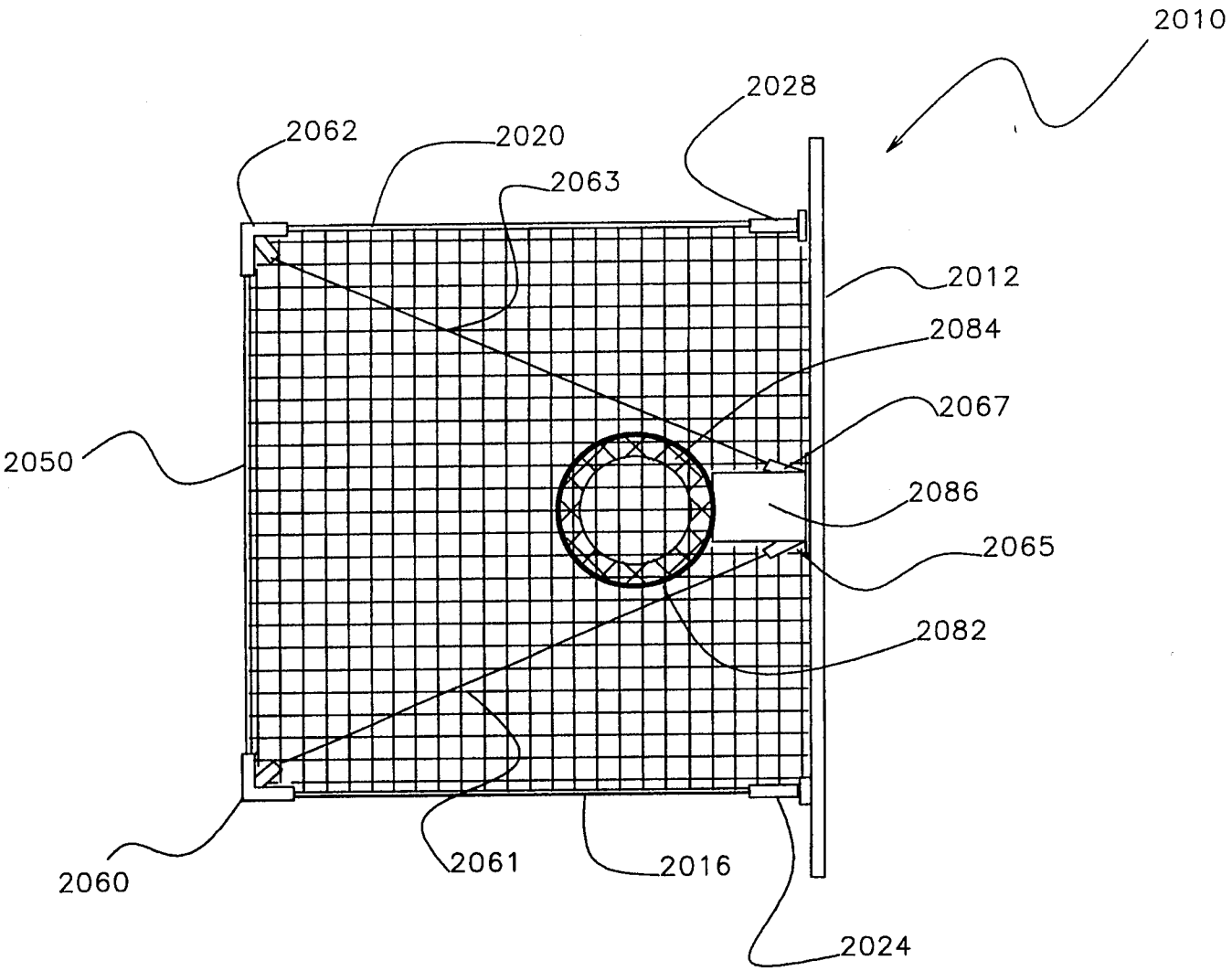
FIG. 20 is a top view of the embodiment shown in FIG. 18.

Referring in particular to FIG. 18, a basketball practice system 2010 having certain characteristics in common with the system of the earlier embodiment is illustrated. Support for the system is provided by a backboard 2012. Backboard 2012 has an extension 2013 integral with it. In turn, backboard 2012 supports a plurality of dowels. In particular, horizontal dowels 2016 and 2020 are mounted on backboard 2012 using respective brackets 2024 and 2028, as illustrated in FIGS. 18–20. Brackets 2024 and 2028 are of the type which include a base for attaching to backboard 2012 and a tubular receiving neck for receiving a dowel. The bracket illustrated in FIG. 2 may be used.

An additional horizontal dowel 2050 extends in a parallel direction to the backboard 2012 between dowels 2016 and 2020. Diagonal dowels 2061 and 2063 extend diagonally upward from the backboard 2012 to the intersections of horizontal dowels 2016 and 2050 and horizontal dowels 2020 and 2050, respectively. The diagonal dowels 2061 and 2063 are fastened to the backboard 2012 via brackets 2065 and 2067, as illustrated in FIGS. 18–22, particularly FIG. 22. The brackets 2065 and 2067 include a base for engaging the backboard 2012 and an angularly extending tubing for engaging the diagonal dowels. The dowel intersection including dowels 2061, 2016 and 2050 and the intersection including dowels 2063, 2020 and 2050 are secured together by corner brackets 2060 and 2062, respectively, illustrated in FIG. 21. The brackets 2060 and 2062 each include two perpendicularly aligned tubes and a diagonal tube extending from the intersection of the same.

A hoop 2082 with an associated basket net 2084 is maintained in place by a support 2086 which is secured to backboard 2012. The hoop 2082 is positioned on the vertical centerline of the backboard 2012 approximately five inches downward from the top edge of the horizontal dowel 2050.

Shots by the player, are collected by a wedge shaped net formation 2088 comprised of three triangularly shaped nets fastened at their edges and extending between the horizontal and diagonal dowels and backboard as shown in FIGS. 18–20. The three triangularly shaped portions are formed and bordered by dowels 2016, 2061 and backboard 2012; dowels 2050, 2063 and 2061; and dowels 2020, 2063 and backboard 2012. The netting can be fastened to the dowels and backboard via adhesive or any other suitable means. The net formation 2088 has an output coupled to a tubular coupling member 2090.

The coupling 2090 may be a simple cylinder of metal or plastic, or section of metal tubing. Coupling 2090 is secured to backboard 2012 and is, in turn, coupled to a length of compressible bendable air conditioner or heating conduit 2092. Conduit 2092 is of a construction which incorporates a spiral metal rib 2094 which acts as a support for an outer casing 2096 made of paper, foil or similar material. Casing 2096, is, in turn, attached at its other end to a rope 2097 used to secure the casing to a stand. Casing 2096 is also attached to a coupler 2098 and couplings 2090 and 2098 are attached to conduit 2092.

In accordance with the preferred embodiment, it is expected that couplings 2090 and 2098 will be made of plastic or, if desired, metal. Coupling 2098 can be provided with a mounting member, as in the FIG. 6 embodiment, which allows it to be attached to a piece of furniture using a Velcro brand fastener or any other suitable fastener. Preferably, however, for this embodiment, a string 2097 can be used for attaching member 2092 and coupling 2098 to a stand 2124, shown in FIG. 19, comprised of a base 2126 and vertical support pole 2128 having holes therethrough for engaging the string 2097.

Rigidity to the stand is provided by several diagonal braces, a first brace 2130 and a second brace not shown, extending downwardly from the vertical pole 2128 to the base 2126. The braces are made of dowels and are maintained in place on the base by a first bracket 2132 secured to the base, shown in FIG. 19, and second bracket, not shown, similar to the first bracket. The braces are connected via pins or the like to a lower hole of the vertical support pole 2128. Also, the stand 2124 has a rectangularly shaped base 2126 comprising the bottom end thereof. The base lies flat on a surface and is large enough to fit a chair thereon, as shown in FIG. 20.

The system is used similarly to the system illustrated in FIG. 9, wherein, during use, balls are tossed from a remote position into the rectangular opening defined by the dowel members 2016, 2020 and 2050, perhaps causing them to bounce against backboard 2012 and fall through hoop 2082 or fall around hoop 2082 into wedge shaped net formation 2088. For this embodiment, the remote position is a chair positioned on the base 2126 which acts as a sitting place and also a manner for securing the base and stand in place. By positioning the hoop 2082 lower than a top edge of the rectangular opening defined by the dowels, a deflection structure is inherently formed wherein the wedge shaped net formation extending over the hoop 2082 is used to deflect the ball inwardly on odd bounces. After a ball 2122 is thrown, it falls into coupling 2090 and is conveyed through conduit 2092 to the remote location, the chair, at which coupling 2098 is located where it may be caught by the player, who then simply shoots another basket without the necessity of retrieving the basketball.

The system 2010 may be mounted in a manner similar to the FIG. 6 embodiment of the system as shown in FIG. 7 for the FIG. 6 embodiment. Alternatively, the system may be supported by having the backboard nailed or put on a picture hook secured to a wall 1166 as illustrated in FIG. 9 for the FIG. 6 embodiment.

INDUSTRIAL APPLICABILITY

Figure 10:
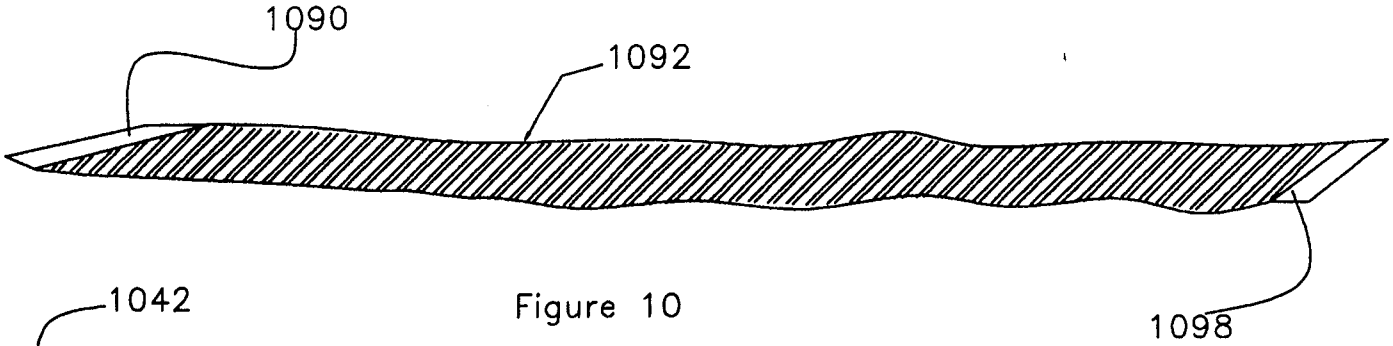
FIGS. 10–17 illustrates the various parts of the invention and their facility for being packaged as a flat shipping unit.

The present invention is particularly suitable for application to modern distribution methods. As an example representative of the embodiments disclosed, the inventive system 1010 may be easily packaged in a relatively flat container or mounted on backboard 1012 and blister packaged. As can be seen in FIG. 10, conduit 1092 for guiding the balls back toward the user may be compressed and slanted diagonally. Couplings 1090 and 1098 may be made of relatively short length on the order of two centimeters, thus facilitating their being compressed into a small size.

Figure 11:
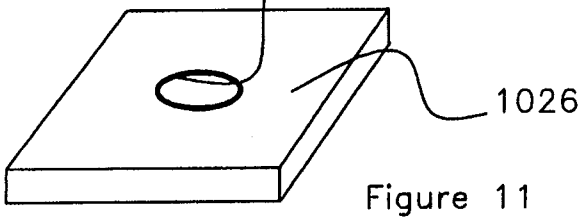
Figure 12:
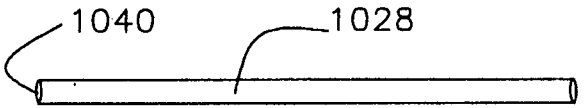
Figure 13:
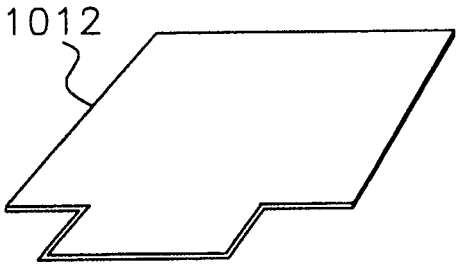
Figure 14:
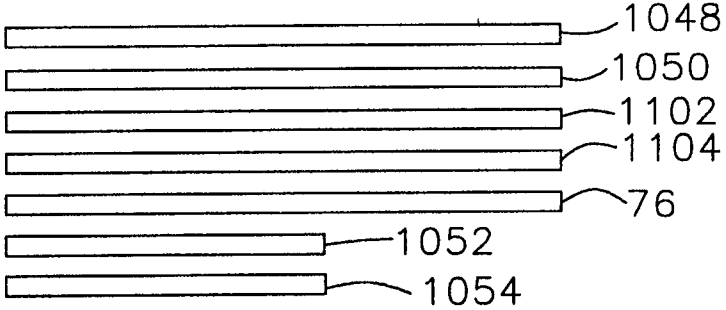
Figure 15:
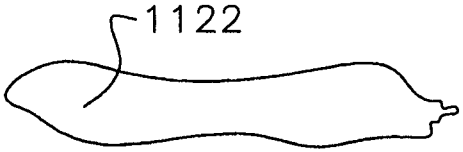
Figure 16:
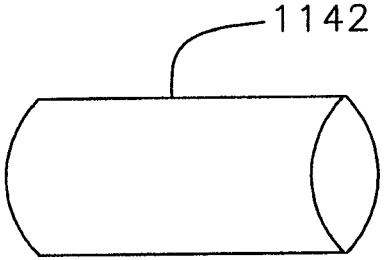
Figure 17:
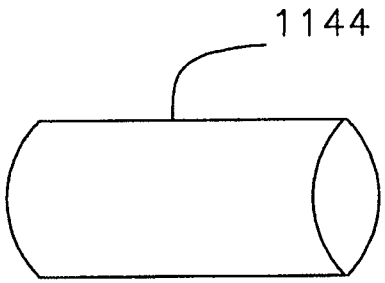
Figure 22:
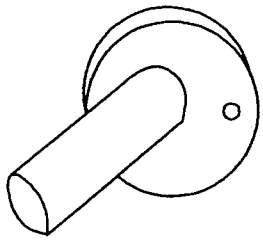
FIG. 22 illustrates a diagonal dowel bracket used in the embodiment shown in FIG. 18.
Figure 21:
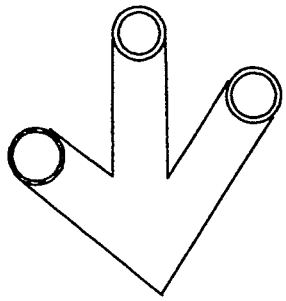
FIG. 21 illustrates a corner bracket used in the embodiment shown in FIG. 18.

As shown in FIG. 11, support 1124 may be broken down into a flat base 1126 and a pole 1128 which is provided with threads 1140 which mate with threads in a taped hole 1142 in base 1126. As can be seen in FIG. 13, backboard 1012 is a flat member and, in the context of blister packaging may take the place of the cardboard card normally used in such packaging techniques. As illustrated in FIG. 14, the various dowels which comprise the system are also of relatively small size and can be packaged in the desired flat container. If desired, even ball 1122 may be deflated for such packaging as shown in FIG. 15. Finally, a plurality of brackets may be packaged in a plastic envelope 1142, as illustrated in FIG. 16 and the net packaged in another plastic envelope 1144, as illustrated in FIG. 17. These elements, together with the other elements illustrated in FIGS. 10–12 and 14–1, may be disposed over and blister packaged to the backboard illustrated in FIG. 13.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. A ball shooting practice system, comprising:

a) a backboard made of a substantially rigid material;

b) a tapered guiding member having a wide input port and a narrow output, said tapered guiding member being configured and dimensioned to guide a ball into said narrow output;

c) a self-supporting deflection structure for deflecting balls, which are moving away from the system, and guiding them into said tapered guiding member;

d) a ball target positioned above said narrow output; and e) a bendable tubular guiding member coupled to said narrow output and configured to receive said ball and guide it toward a player using said ball practice system.

2. A ball shooting practice system as in claim 1, wherein said deflection structure comprise netting.

3. A ball shooting practice system as in claim 1, wherein said bendable tubular guiding member is secured to said backboard at a position on said bendable tubular guiding member proximate to said narrow output.

4. A ball shooting practice system as in claim 3, wherein said bendable tubular guiding member comprises a cylindrical member secured to the end of said bendable tubular guiding member and proximate to said narrow output, and wherein said bendable tubular guiding member is secured to said backboard.

5. A ball shooting practice system as in claim 3, further comprises a frame structure secured to said backboard wherein said frame structure comprising a plurality of cross braces secured between said frame structure and said backboard in order to give rigidity to said frame.

6. A ball shooting practice system as in claim 5, wherein the end of said bendable tubular guiding member opposite the end, proximate to said narrow output has a fastener secured proximate to said end, whereby said fastener may be secured at a position convenient to the user.

7. A ball shooting practice system as in claim 5, wherein said ball target is positioned below the top of said tapered guiding member.

8. A ball shooting practice system as in claim 5, further comprising a vertical support member with a mating fastener for mating with a fastener which is secured to the end of said bendable tubular guiding member opposite the end of said bendable tubular guiding member proximate to said narrow output.

9. A ball shooting practice system as in claim 1, wherein said bendable tubular guiding member defines an elongated open guide path for said ball, said guiding member comprising support structure which maintains said guiding member in a configuration with said guide path in a substantially open configuration without external support.

10. (amended) A ball shooting practice system as in claim 9, wherein said support structure of said bendable tubular guiding member comprises a spiral backbone and a skin secured to said spiral backbone.

11. A ball shooting practice system as in claim 1, wherein said bendable tubular guiding member has a spiral backbone and a skin secured to said spiral back bone.

12. A ball shooting practice system as in claim 1, further comprising a vertical support member with a mating fastener for mating with a fastener which is secured to the end of said bendable tubular guiding member opposite the end of said bendable guiding member proximate to said narrow output.

13. A ball shooting practice system as in claim 1, wherein said ball target is positioned below the top of said tapered guiding member.

14. A ball shooting practice system as in claim 1, wherein the end of said bendable tubular guiding member opposite the end, proximate to said narrow output has a fastener secured proximate to said opposite end whereby said fastener may be secured at a position convenient to the user.

15. A ball shooting practice system as in claim 14, wherein the end of said bendable tubular guiding member opposite the end, proximate to said narrow output is support at a desired position by a support member comprising a pole mounted to a base and an attachment member adapted to attached to the opposite end of said bendable tubular guiding member.

16. A ball shooting practice system as in claim 1, wherein said deflection structure is maintained rigid by a plurality of diagonal support members secured to members forming said deflection structure.

17. A ball shooting practice system as in claim 1, wherein said ball target comprises a rigid hoop and an open bottomed basket secured to said hoop.

18. A ball shooting practice system, comprising:

a) a backboard made of a substantially rigid material;

b) a tapered guiding member having a wide input port and a narrow output, said tapered guiding member being configured and dimensioned to guide a ball into a narrow output defined by said tapered guiding member;

c) a self supporting deflection structure for deflecting balls, which are moving away from the system, and guiding them into said tapered guiding member;

d) a ball target positioned above said narrow output; and e) a bendable tubular guiding member coupled to said narrow output and configured to receive a ball and guide it toward a player using said ball practice system, wherein the end of said bendable tubular guiding member opposite the end, proximate to said narrow output has a fastener secured proximate to said opposite end, whereby said fastener may be secured at a position convenient to the user.

19. A ball shooting practice system, comprising;

a) a backboard;

b) a tapered guiding member having a wide input port and a narrow output, said tapered guiding member being configured and dimensioned to guide a ball into a narrow output defined by said tapered guiding member;

c) a ball target positioned above said narrow output; and d) a compressible bendable tubular guiding member coupled to said narrow output and configured to receive a ball and guide it toward a player using said ball shooting practice system.

20. A ball shooting practice system as in claim 19, wherein said compressible bendable tubular member comprises a vertical support member with a mating fastener for mating with a fastener which is secured to the end of said compressible bendable tubular guiding member opposite the end of said compressible bendable tubular guiding member proximate to said narrow output.

* * * * *